US005132652A

United States Patent [19]

Doehler et al.

[11] Patent Number: 5,132,652

[45] Date of Patent: * Jul. 21, 1992

[54] HIGHPOWER MICROWAVE TRANSMISSIVE WINDOW ASSEMBLY

[75] Inventors: Joachim Doehler, Union Lake; Buddie Dotter, II., Utica; Jeffrey M. Kirsko, Highland; Lester R. Peedin, Oak Park, all of Mich.

[73] Assignees: Energy Conversions Devices Inc., Troy, Mich.; Canon Inc., Tokyo, Japan

[ * ] Notice: The portion of the term of this patent subsequent to Jun. 5, 2007 has been disclaimed.

[21] Appl. No.: 439,057

[22] Filed: Nov. 20, 1989

Related U.S. Application Data

[63] Continuation of Ser. No. 179,617, Apr. 8, 1988, Pat. No. 4,931,756.

[51] Int. Cl.[5] ..... H01P 1/08

[52] U.S. Cl. ..... 333/252; 333/99 PL

[58] Field of Search ..... 333/252, 99 PL

[56] References Cited

U.S. PATENT DOCUMENTS

| | | | |
|---|---|---|---|
| 3,210,699 | 10/1965 | Tagano | 333/252 |
| 3,387,237 | 6/1968 | Cook | 333/252 |
| 4,286,240 | 8/1981 | Shively et al. | 333/252 |
| 4,371,854 | 2/1983 | Cohn et al. | 333/252 |
| 4,458,223 | 7/1984 | Schmidt | 333/252 |
| 4,620,170 | 10/1986 | Lavering | 333/252 |
| 4,931,756 | 6/1990 | Doheler et al. | 333/252 |

*Primary Examiner*—Paul Gensler

*Attorney, Agent, or Firm*—Krass & Young

[57] ABSTRACT

A window assembly for transmitting relatively high power microwave energy from a waveguide, held at substantially atmospheric pressure levels, into a microwave reaction chamber at sub-atmospheric pressure levels. The window assembly provides for the transmission of microwave energy to generate a glow discharge plasma without suffering from catastrophic failure as a result of excessive temperature and pressure conditions.

25 Claims, 3 Drawing Sheets

HIGHPOWER MICROWAVE TRANSMISSIVE WINDOW ASSEMBLY

FIELD OF THE INVENTION

This application is a continuation of pat. application Ser. No. 179,617 filed Apr. 8, 1988, now U.S. pat. No. 4,931,756.

The instant invention relates generally to an apparatus for depositing or etching films through the use of a microwave initiated plasma and more particularly to a microwave plasma deposition apparatus employing an improved window assembly adapted to uniformly transmit, without cracking or overheating, high power microwave energy from a source, such as a waveguide, into the interior of a vacuum deposition/etch chamber.

BACKGROUND OF THE INVENTION

The instant invention has general applicability to any type of apparatus which requires the introduction of high power, microwave energy from a source, such as a waveguide or antenna, maintained at substantially atmospheric pressure, into the interior of a vacuum chamber, maintained at sub-atmospheric pressure. The microwave energy is preferably introduced into the vacuum chamber for effecting a glow discharged plasma. which plasma is utilized to either deposit a semiconductor or insulating material onto the exposed surface of a substrate or to remove (etch) material from that exposed surface. Whereas, the instant invention has universal applicability to microwave apparatus, said invention enjoys particularly important applicability in the fabrication of photoresponsive alloys and devices for various photoconductive applications, including the fabrication of electrophotograhic photoreceptors.

Since the deposition of relatively thick films of amorphous silicon alloy material and germanium alloy material onto the circumferential surface of cylindrically-shaped drums for fabricating electrophotographic photoreceptors provides the first preferred embodiment of the invention disclosed herein, the instant inventors will primarily discuss the deposition of such amorphous silicon alloy material and amorphous germanium alloy material; however, it is to be borne in mind that the applicability of the high power dielectric window assembly of the instant invention to the deposition of any thin or thick film material is well within the scope of the instant invention. In fact, the microwave glow discharge deposition of many different types of materials, such as thin film or thick film dielectric material or thin film or thick film layers of clear, transparent wear resistant coatings, interference filters, transparent electrically conductive coatings, etc., are also within the scope of the instant invention. Alternatively, and of equal importance , is the fact that the high power microwave window apparatus of the instant invention may be employed with equal advantage in a vacuum chamber adapted to etch or otherwise treat or modify the surface of a substrate.

It must therefore by appreciated that regardless of the type of microwave plasma operation (deposition or ethc) being conducted, the rate at which that operation occurs can be controlled, inter alia, by controlling the power at which the microwave energy is transmitted into the interior of the vacuum chamber. In order to deposit or etch at a high rate, it is necessary to utilize high power levels, e.g., in the kilowatt range and preferably 3 or more kilowatts. The trouble which arises from the use of high power microwave energy is that said high power microwave energy tends to cause heating of the dielectric window through which said microwave energy is coupled into the interior of the vacuum chamber. Prolonged or excessive heating of the dielectric window can cause the cracking thereof, which cracking results in the catastrophic failure of the deposition/etch operation. Of course, because microwave plasmas are highly energetic in nature, even the introduction of relatively low microwave power into the vacuum chamber over a relatively lengthy period of time can also cause the dielectric window to overheat and fail. Therefore, there exists a need for a dielectric window through which high power microwave energy can be coupled into the interior of a glow discharge plasma deposition/etch chamber, which dielectric window is capable of prolonged usage without failure.

As mentioned hereinabove, the instant invention has particular relevance to the fabrication of electrophotographic photoreceptors because the semiconductor alloy material required to be deposited upon the circumferential surfaces thereof can be over 40 microns in total thickness. (Note that this is to be contrasted with the fabrication of thin film solar cells which only require the deposition of less than 1 micron, in total thickness, of semiconductor alloy material.) The relevance of the instant invention to electrophotographic drums is because the economics of fabrication necessitate that a high deposition rate process be employed. Due to the particular relevance of electrophotographic photoreceptors to the instnt invention, the following paragraphs are intended to provide a better understanding of the structure of said electrophotographic photoreceptors in which it is contemplated that said microwave deposition apparatus will be initially utilized.

Approximately 45 years ago, C. Carlson developed the first electrophotographic process based upon a sulfur material. Other chalcogenides such as selenium and selenium alloys were thereafter suggested for use in such applications together with organic substances such as polyvinly carbazole (PVK). Selenium and selenium alloys however, were found to possess several inherent shortcomings including for example, high toxicity, which renders the drums difficult to handle; relative softness making said materials subject to rapid wear and abrasion; and poor photoresponsiveness, particularly in the infrared region. In contrast thereto, amorphous silicon alloy materials were considered practical alternatives because they were found to be relatively hard, non-toxic and able to demonstrate excellent photoresponse to infrared radiation. Also, by this point in time, it was possible to fabricate amorphous silicon alloy materials with a reduced density of states so that charging of those materials to the potentials required for electrophotographic replication was considered possible. Thus, it was realized that photoreceptors formed from amorphous silicon alloy material, if such photoreceptors were manufacturable in an economical fashion, would provide superior environmental, photoresponsive and structural characteristics, vis-a-vis chalcogenide photoreceptors.

With the passage of time, research into the fabrication of amorphous silicon alloy materials continued and the density of localized states in the energy gap thereof were further reduced; and hence, the quality of those materials for all photoresponsive applications were improved. These materials of improved quality were preferentially deposited by a glow discharged decomposition process wherein a silicon containing feedstock gas such as silane was introduced into a vacuum vessel. It was within said vessel that said feedstock gas was decomposed by an r.f. glow discharge and deposited onto the surface of a substrate at a substrate temperature of about 225 to 325 degrees Centigrade and a pressure of about 0.5 torr. The semiconductor alloy material so deposited was an intrinsic (although slightly n-type) amorphous silicon alloy material consisting of silicon and hydrogen.

In order to produce a doped amorphous silicon alloy material, a gas containing a Group VB element such as phosphine or a gas containing a Group IIIB element such as diborane, was premixed with the feedstock silane gas and passed through said glow discharge vacuum vessel under the same operating conditions as set forth in the previous paragraph. By employing these dopant gases, it became possible to fabricate layers of either n-type or p-type amorphous silicon alloy materials. The fabrication of amorphous silicon alloy material in this manner combined hydrogen with silane at an optimum temperature so that the hydrogen was able to passivate some of the dangling, strained or otherwise stressed bonds of the deposited silicon matrix material, thereby substantially reducing the density of localized states in the energy gap thereof. The result was that the electronic and optical properties of the amorphous silicon alloy material were vastly improved.

While the amorphous silicon alloy materials made by the process described hereinabove, demonstrated photoresponsive characteristics suitable for the production of photovoltaic devices and other photoresponsive applications, any type of process which relies on r.f. generated plasmas suffers from relatively slow deposition rates and relatively low utilization of feedstock gas. Both of these deficiencies are important considerations from the standpoint of the commerical manufacture of photovoltaic devices and, particularly, to the commerical manufacture of electrophotographic photoreceptors. Indeed, by employing r.f. glow discharge processes, it was only possible to obtain a deposition rate of less than about 20 angstroms per second and the production of a single electrophotographic drum required approximately 24 hours. Additionally, these prior art r.f. processes which increased the magnitude of the power density in order to obtain enhanced deposition rates, resulted in the production of films having poor electrical properties due to an increased density of defect states in the deposited silicon alloy material. Further, said prior art r.f. processes were inherently limited in the degree to which the feedstock gases introduced into the vacuum chamber could be energized, and hence the rate of deposition which could be achieved.

As the inherent advantages of amorphous silicon electrophotographic photoreceptors and the inherent shortcomings of the r.f. glow discharged fabrication of those photoreceptors became apparent, the assignee of the instant invention undertook research directed toward the development of a faster, more economical and more efficient method of fabricating amorphous silicon alloy materials for use in electrophotographic applications. Such a method, which includes the employment of a refreshingly innovative apparatus for the simultaneous deposition of silicon alloy material onto the circumferential surface of a plurality of electrophotographic photoreceptors was developed and is fully described in commonly assigned U.S. Pat. No. 40729,341 to Fournier, et al for "Method and Apparatus for Making Electrophotographic Devices", the disclosure of which is incorporated herein by reference.

The specification of the Fournier, et al reference teaches the construction of an apparatus specifically adapted to utilize microwave energy so as to facilitate the simultaneous, uniform, microwave glow discharge deposition of amorphous silicon alloy material over the entire cimcumferential surface of a plurality of elongated, substantially cylindrically shaped drum members. Those drum members have successive layers of silicon alloy of differing conductivity types or differing amorphicity deposited thereupon so as to be used as the photoconductive media for electrophotographic copier machines. By utilizing the concept of microwave initiated glow discharge taught by the Fournier, et al '341 reference, substantially all reaction feedstock gas introduced into the vacuum chamber is decomposed. Further, by utilizing the special geometry defined therein by the aligned, spacedly positioned, cylindrically-shaped drum members, over 70% of the decomposed reaction gases may be uniformly, simultaneously and rapidly deposited upon the circumferential surfaces of those cylindrically shaped drum members. Therefore, both, the feedstock gas conversion efficiency and the utilization efficiency is extremely high, vis-a-vis, comparable r.f. plasma apparatus.

The structural arrangement of the elements in that microwave deposition apparatus must be understood in order to understand the manner in which the instant invention defines thereover. The microwave deposition apparatus of Fournier, et al '341 includes a substantially enclosed inner chamber defined by the aforementioned plurality of closely spaced, operatively disposed, cylindrically shaped members. The inner chamber includes a plasma deposition region into which feedstock reaction gas is introduced. The feedstock gas is decomposed by microwave energy also introduced into said plasma deposition region by a waveguide through an alumina window assembly. The alumina window assembly comprises a single, planar alumina window permanently affixed to the terminal end of said waveguide and disposed in operative communication with said inner chamber. The alumina window not only defines one end of the plasma region, but said window also forms the vacuum seal between the waveguide (maintained at atomspheric pressure) and the sub-atmospheric chamber. It is this arrrangement of apparatus which efficiently transmit relatively, (vis-a-vis, the kilowatt power ranges now being investigated) low power microwave energy into the plasma region of the vacuum chamber for effecting the deposition of decomposed gases onto the circumferential surfaces of the photoreceptors.

At relatively low levels of microwave power, the microwave deposition apparatus of Fournier, et al '341 is adapted to deposit, for example, approximately 50–100 angstroms per second of amorphous silicon alloy material onto the circumferential surfaces of the cylindrically shaped members. While this deposition rate represents a significant improvement over the deposition rate achieved by conventional r.f. glow discharge methods (as well as the concommitant improvement in feedstock gas utilization), if the power density of microwave energy being introduced could be further increased; ( 1) still more efficient gas decomposition and hence deposition rates could be obtained and (2) the deposition of microcrystalline silicon alloy material would be simplified. Obviously, such higher power densities would additionally provide for increased and more efficient etching processing in applicable situations.

The inventors of the instant invention have attempted to improve the efficiency of deposition of the silicon alloy material in such drum deposition apparatus by increasing the microwave power level so as to deposit said silicon alloy material at a rate in excess of approximately 100 angstroms per second. This method has indeed proven successful in increasing deposition rates and in facilitating the economical deposition of microcrystalline silicon alloy material; however, the increased power densitites have exposed a weakness in the design of that microwave initiated glow discharge deposition apparatus. Specifically, the alumina window of the Fournier, et al '341 microwave deposition apparatus was proven to be incapable of withstanding the elevated temperatures generated by the more energetic microwave plasma initiated by utilizing high power densities. Moreover, the inventors of the instant invention have observed catastrophic failure, such as rupture and cracks in both the alumina window and the vacuum seal (which seal effects an airtight closure between the waveguide and the alumina window). The instant inventors have also found that similar failure modes of said alumina window develop during lengthy periods of operation of the microwave apparatus at even relatively low power densities. Said inventors are confident that both of these failure modes are a result of overheating of the window occasioned by (1) the failure to properly match the coefficient of thermal expansion of the material from which the dielectric window is fabricated with that of the vacuum seal, and (2) the fact that because alumina is characterized by a relatively low resistance to thermal shock, the dielectric window cannot withstand, for lengthy periods of time, the elevated temperatures, (temperatures in excess of 500° Centigrade) typically associated with high power microwave plasmas. It is to be noted that the typical failure modes of said dielectric window are occasioned by (1) the exposure of the window to elevated temperature; and (2) the deposition of amorphous silicon alloy material onto the surface of the window, which material crystallizes due to elevated temperatures, thereby absorbing microwave energy and forming a hot spot on the window.

Thus, it should be appreciated by those skilled in the art that the power densities employed in microwave deposition apparatus have heretofore been limited by the inherent structural ability of the microwave window assembly to withstand the elevated temperatures associated with plasmas generated by high power microwave energy. It has further been determined that while the aforementioned failure modes may be alleviated by forming the window from a different dielectric material, a more permanent solution would be to provide adequate cooling for said window or window assembly. This is because while a different material would elevate the amount of microwave power which could be introduced before that material failed, an adequate cooling scheme would prevent failure at all practical power densities. Of course, the best of both worlds would be to select optimum dielectric materials and provide adequate cooling for the windows fabricated therefrom.

While the aforementioned discussion has dealt with apparatus for the deposition of materials utilizing high power microwave energy, as mentioned hereinabove, the instant invention may also be employed in apparatus adapted to etch or otherwise treat a surface by a high power microwave sustained etchant plasma. Prior art devices which employ radio frequency energy to initiate and sustain plasmas of precursor etchant gases, have proved defficient in providing a sufficient level of plasma intensity and feedstock gas utilization. Due to the defficiencies inherent in r.f. plasmas, increasing interest has been shown in the use of microwave energy to generate and sustain etchant plasmas. Unfortunately, microwave etching apparatus have heretofore employed the same type of single window assembly design described in detail hereinabove with respect to deposition apparatus. Thus, the amount of microwave power which could be employed in such etchant assemblies was limited by the ability of the dielectric window thereof to withstand the elevated temperatures produced by exposure to highly energetic microwave initiated plasmas.

Accordingly, a need exists for an improved window assembly which can efficiently, economically, reliably, and safely transmit relatively high power microwave energy from a waveguide into a vacuum chamber, for both deposition and etch operations, without suffering damage due to prolonged exposure to elevated temperatures.

SUMMARY OF THE INVENTION

The instant invention provides a new and improved window assembly, which window assembly is adapted to transmit relatively high power microwave energy from a microwave propagating means such as a waveguide, maintained at substantially atmospheric pressure, into the interior of a vacuum chamber, maintained at sub-atmospheric pressure. The window assembly includes two or more dielectric windows which are substantially microwave transparent and are characterized by a relatively high coefficient of thermal conductivity; a vacuum seal adapted to secure the dielectric windows to the propagating means, thereby maintaining the pressure differential therebetween; and cooling means for maintaining the dielectric windows and vacuum seal at a sufficiently low temperature so as to prevent the catastrophic failure thereof, i.e., the cracking or shattering of the window assembly or the rupture of the vacuum seal.

In a preferred embodiment, the dielectric window assembly includes a first generally planar window formed of either beryllium oxide (BeO), alumina ($Al_2O_3$) or other dielectric material characterized by a relatively high coefficient of thermal conductivity and transparency to microwave energy, and at least a second spacedly disposed, concentrically oriented dielectric planar window formed of either beryllium oxide, silicon dioxide ($SiO_2$) or alumina. Additionally the dielectric windows are formed of a material selected to possess a coefficient of thermal expansion which substantially matches the coefficient of thermal expansion of the vacuum seal.

The window assembly cooling means includes a channel formed by the space created between the first planar window and the spacedly disposed, concentrically oriented second planar window, which second planar window is operatively disposed at least 1 mm. from the first planar window, and on the side thereof opposite the interior of the vacuum chamber. The second planar window is fixably attached to a stainless steel sleeve as by a compatible epoxy resin. In a preferred embodiment, the second planar window is formed of alumina, said alumina window is then permanently attached to a substantially nickel:cobalt:iron tube by means of a high temperature resistant (i.e., in excess of 1000° C.), silver based alloy. The nickel:cobalt:iron tube is then metallurgically fastened, e.g., welded, to a stainless steel sleeve.

Similarly, the first planar window is sealably fixed to a to a stainless steel tube having a circumferential dimension at least 0.5 to 5.0 centimeters greater than that of the stainless steel sleeve to which the second planar window is attached. In a preferred embodiment, the first planar window is formed of beryllium oxide and is permanently fixed to a nickel:cobalt:iron tube by means of said high temperature resistant, silver based alloy. Said nickel:cobalt:iron tube is then metallurgically fastened, e.g., welded, to a stainless steel tube at least 0.5 cm larger in circumference than said stainless steel sleeve.

The stainless steel is operatively disposed concentrically within and interiorly of the stainless steel tube assembly. This concentric arrangement allows the outer circumference of said sleeve and the inner circumference of said tube to define a cooling channel which extends to and communicates with the space between the first planar window and the second planar window. A cooling medium, preferably a liquid cooling medium, is pumped through said channel so as to transfer heat from the planar window and assure a uniform, relatively low temperature during operation of the microwave plasma apparatus. By cooling the first planar window to and maintaining uniformly low temperature, higher microwave powers may be employed without deleteriously effecting the first planar window. Preferred cooling media may also include highly microwave transmissive liquids, such as silicone oil, or FREON (registered trademark of Dupont Corp.) although other semi-microwave transmissive cooling media may be employed so long as (1) microwave coupling is not severely degraded, or (2) microwave energy is not too vigorously absorbed.

The stainless steel tube is further designed to include a protective sleeve metallurgically affixed, e.g., welded, thereto, which protective sleeve is adapted to provide structural reinforcement. The protective sleeve additionally includes an apertured base adapted to support and maintain a third planar window, said third window operatively disposed immediately adjacent to and in intimate contact with said first planar window (on the side of said first window opposite said second planar window). This third planar window is typically employed when the instant invention is used in a continuous deposition mode of operation and is readily removable from said apertured base, so that it may be removed and cleaned when it becomes coated with the deposition species. Note that if the third window was not removable for cleaning or replacement, deposited semiconductor alloy material could crystallize and thereby overheat the window and prevent the transmission of microwave energy.

These and other advantages and improvements of the microwave window assembly of the instant invention will become apparent from the detailed description, the drawings and the claims which follow hereinafter.

DETAILED DESCRIPTION OF THE PREFERRED EMBODIMENTS

Figure 1:
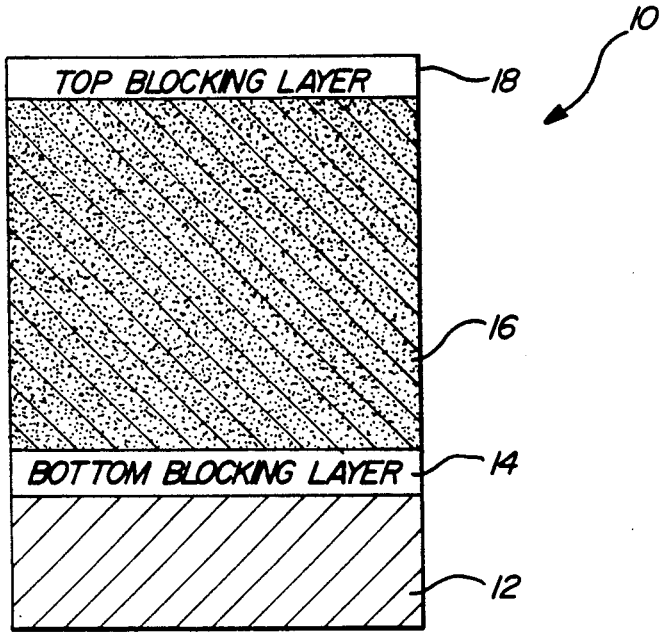
FIG. 1 is a cross-sectional view of an electrophotographic photoreceptor formed by layers of amorphous semiconductor alloy materials deposited thereupon by an apparatus such as that described in FIGS. 2 and 3, which apparatus employs the improved high power window assembly of the present invention.

Referring now to FIG. 1, there is illustrated therein, in partial cross-sectional side view, an electrophotographic photoresponsive device 10 formed by the successive deposition of a plurality of high quality layers of substantially amorphous semiconductor alloy materials onto the outer surface of, for example, a cylindrically shaped member 12. In a first preferred embodiment, the high power microwave transmissive window assembly of the present invention is adapted to operated in a deposition mode and deposit said high quality layers of amorphous semiconductor alloy materials, such as the layers illustrated in FIG. 1, so as to fabricate any one of a plurality of photoresponsive, semiconductor or electronic devices. The novel and improved construction of said window assembly, which construction will be described in detail hereinafter, is its ability to reliably transmit relatively high power microwave energy from atmospheric to sub-atmospheric pressure regimes without cracking. It is to be clearly understood however that this ability to transmit high power microwave energy without cracking is readily applicable to the development of etchant plasmas as well as deposition plasmas, the only difference being the introduction into the vacuum chamber of an etchant gas such as carbon tetrafluoride instead of a deposition gas such as silane.

Returning now to FIG. 1, the cylindrically-shaped member 12 forms the substrate upon which the successive layers of semiconductor alloy material of the device 10 are deposited. As illustrated, the electrophographic photoreceptive device 10 includes a first blocking layer 14 deposited onto the electrically conductive substrate 12, a photoconductive layer 16 deposited onto the first blocking layer 14, and a second blocking layer 18 deposited onto the photoconductive layer 16. The photoconductive layer 16 is preferably formed from an amorphous semiconductor alloy material and more particularly, an amorphous silicon alloy material containing silicon and hydrogen and/or fluorine. Depending upon the type (insulative or semiconductive; microcrystalline or amorphous) of blocking layers 14 and 18 selected, and the conductivity type of charge utilized in charging the device 10, the photoconductive region 16 can also include small amounts of a dopant to render the region 16 of slightly p-type or n-type conductivity.

It is to be noted that the bottom blocking layer 14 is designed to preclude charge carrier injection from the electrically conductive substrate 12 into the photoconductive region 16. To that end, the bottom blocking layer 14 can be made electrically insulative when formed from an amorphous alloy including silicon and carbon, silicon and oxygen, or silicon and nitrogen. In forming such bottom blocking layers, reaction gas mixtures of silane ($SiH_4$) and/or silicon tetrafluoride ($SiF_4$) with methane ($CH_4$), ammonia ($NH_3$), nitrogen ($N_2$) or oxygen can be used. Such blocking layers are charge neutral and therefore suitable for use for the positive as well as negative charging of the electrophotographic device 10.

If positive charging of the electrophotographic device 10 is desired, the bottom electron blocking layer 14 can be, for example, a p-type amorphous silicon alloy material formed from reaction gas mixtures including silane and/or silicon tetrafluoride with a p-type dopant-containing compound such as diborane ($B_2H_6$) or boron trifluoride ($BF_3$). This p-type bottom blocking layer may be microcrystalline as fully disclosed in commonly assigned U.S. Pat. No. 4,582,773, the disclosure of which is incorporated herein by reference. In this case, it is also preferred that the photoconductive region 16 be formed from an amorphous silicon alloy material which includes a small amount of compensating p-type dopant so that the alloy is characterized by substantially intrinsic properties.

The top blocking layer 18 can be formed from any of the gaseous semiconductor precursors or gaseous insulative precursors mentioned with respect to the bottom blocking layer 14. Hence, the top blocking layer can be formed from an insulative material, although it is preferably formed as a p-type or n-type amorphous semiconductor alloy material, as described hereinabove. It is to be specifically noted that the gaseous precursors, the nature of the layers of semiconductor alloy material from which said electrophotographic photoreceptor device 10 is fabricated and the manner of operation of said device 10 forms no part of the instant invention. The photoreceptor enbodiment of the instant invention is demonstrated as an exemplary embodiment because, as will be demonstrated hereinbelow, the photoconductive region 16 thereof is relatively thick and therefore the input of high power microwave energy to form said photoreceptor device 10 in an economical manner is of critical importance. Of course, the high power microwave window assembly of the instant invention is adapted to provide that high power microwave transmission.

The photoconductive region 16 of said photoreceptor device 10 is preferably thick, on the order of 25 microns, in order to facilitate the build up of a charging potential thereacross of over 350 volts. In order to manufacture such thick film photoreceptor devices on a commercial basis, it is necessary to deposit at least the semiconductor alloy materials from which the photoconductive region 16 are fabricated by a method which is characterized by high deposition rates. As mentioned hereinabove, conventional radio frequency glow discharge deposition techniques are not sufficiently energetic to provide for the formation of the entire 25 microns thick photoconductive region 16 in less than about 20 hours (deposition rates of no more than 20 angstroms per second). However, microwave energy excited glow discharge plasmas, being much more energetic than r. f. plasmas, facilitate the deposition of the photoconductive region 16 at deposition rates (over 100 to 200 angstroms per second) which render the fabrication such devices from amorphous silicon alloy material commercially viable. However, the ability to obtain and sustain such rates of deposition depends upon the ability of the microwave transmissive window assembly to introduce, for prolonged periods of time, high power microwave energy into the vacuum environment. The high power microwave transmissive window assembly described in detail hereinbelow, provides for the prolonged transmission be of relatively high power microwave energy for forming a highly energetic plasma from which the semiconductor alloy materials of the photoreceptor device 10 can be deposited. Through the prolonged use of high power microwave energy, the deposition of said materials occurs at substantially accelerated rates with feedstock gas utilization not heretofore possible.

Figure 3:
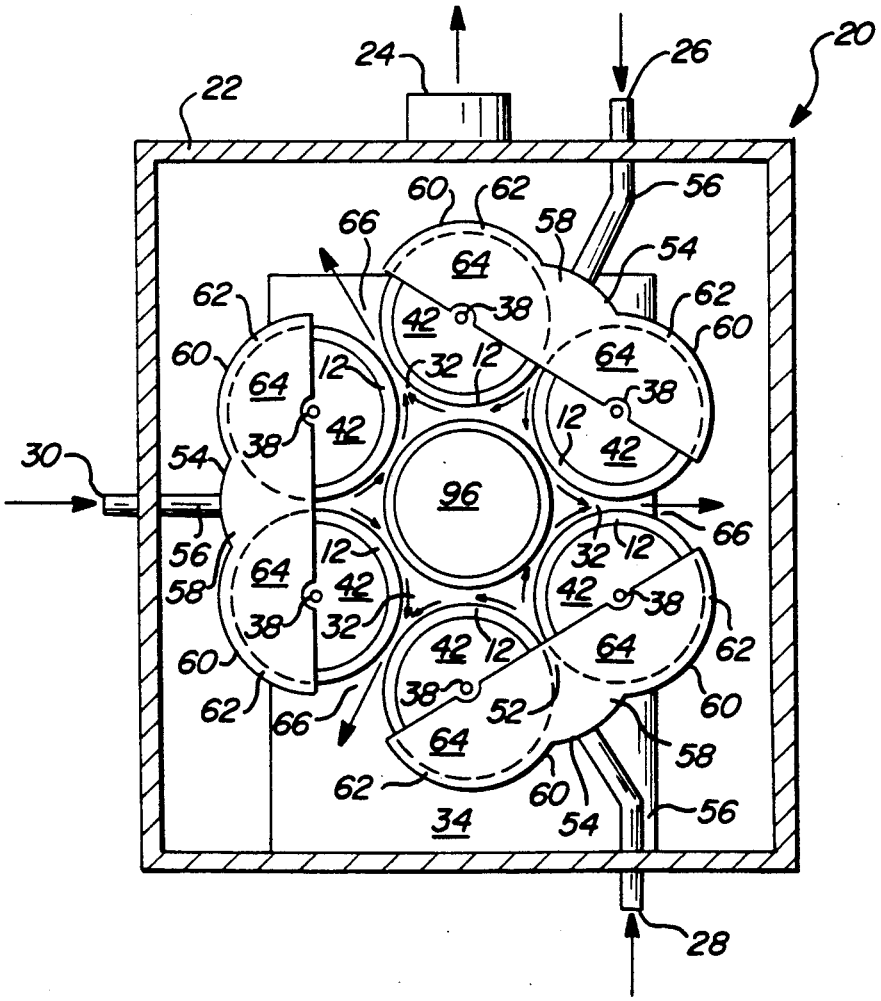
FIG. 3 is a cross-sectional view taken along lines 3—3 of FIG. 2 illustrating the manner in which the improved high power window assembly of the instant invention is adapted to introduce microwave energy into the inner chamber defined by the plurality of photoreceptors.
Figure 2:
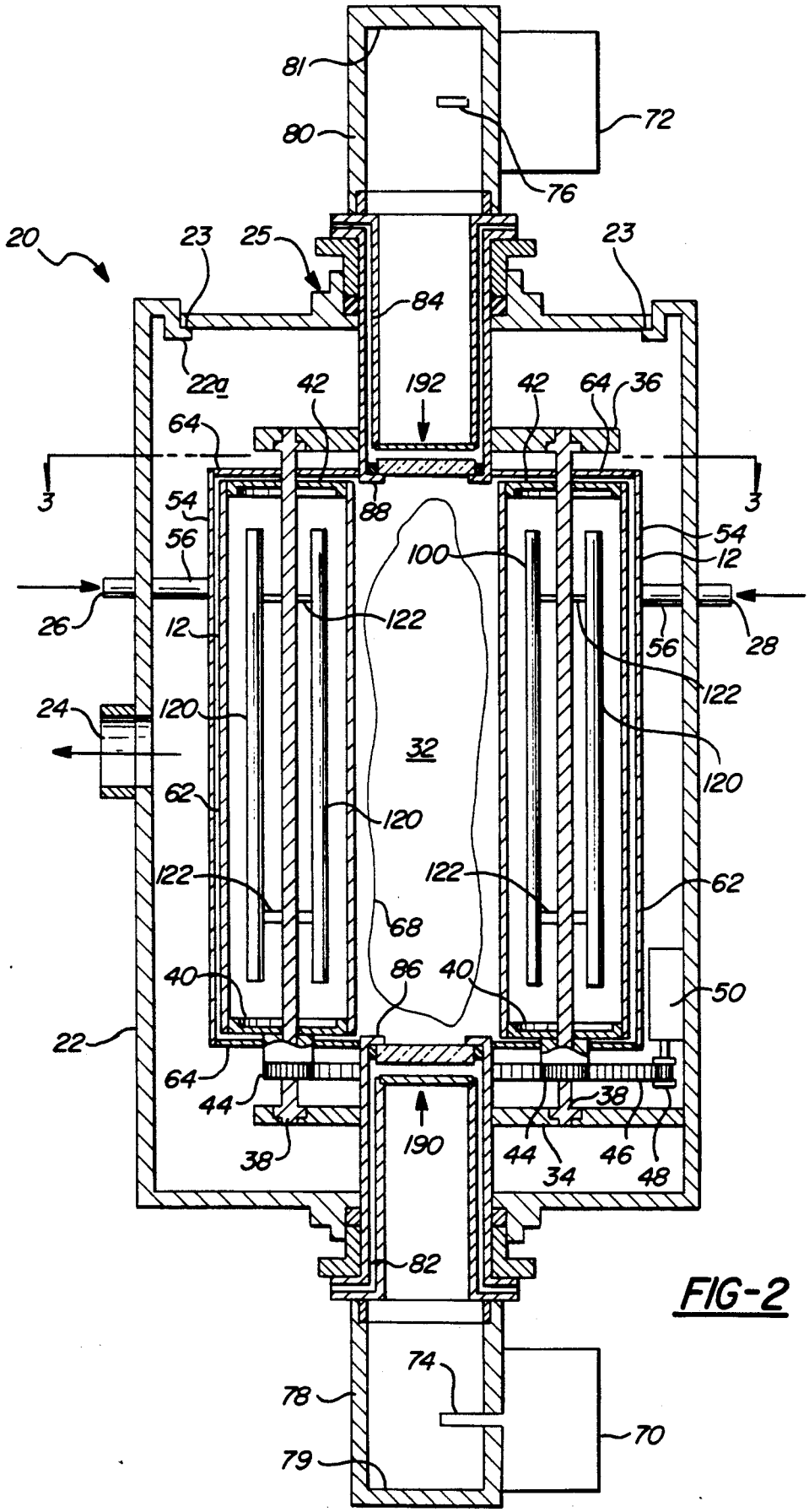
FIG. 2 is a side elevational view, partially in cross-section, of the inner chamber of a microwave initiated glow discharge deposition apparatus particularly structured to simultaneously deposit semiconductor alloy material onto a plurality of photoreceptors and employing the improved high power window assembly of the present invention.

Referring now to FIGS. 2 and 3, illustrated therein is a vacuum deposition apparatus, indicated by the reference numeral 20, which apparatus includes the high power microwave transmissive window assembly of the present invention. The deposition apparatus 20 is specifically adapted to successively deposit layers of material, preferably amorphous semiconductor alloy materials, onto the circumferential surface of a plurality of cylindrically-shaped, drum-like members 12. The apparatus 20 includes a generally rectangularly-shaped vacuum deposition chamber 22. The vacuum chamber 22 includes a pump-out port 24 adapted for (1) suitable connection to a pump for exhausting reaction products from the interior of the chamber 22 and (2) to maintaining the interior of the chamber 22 at an appropriate sub-atmospheric pressure selected to facilitate the deposition process therein. The chamber 22 further includes a plurality of reaction gas input ports 26, 28, and 30 through which reaction gases are introduced into the microwave initiated glow discharge deposition region 32 in a manner to be described hereinafter. The chamber 22 also includes a vacuum seal 23 which effects an airtight seal between the flanged lip **22*a* of the top wall of said chamber 22 and a removable top wall portion 25 thereof. The top wall portion 25 is adapted to be lifted from chamber 22 for purposes of loading and unloading the drum carousel 36 when the apparatus 20** functions in a continuous mode of operation.

It is to be understood that the continuous mode of operation referred to hereinabove, refers to a preferred embodiment of the deposition apparatus wherein one carousel of six elongated drum members 12 is removed from the vacuum chamber 22 and a fresh carousel of six elongated drum members is inserted into said vacuum chamber. This is accomplished by removing the upper microwave assembly from the removable top wall portion 25; hoisting the top wall portion 25, the carousel 36 and the drums 12 supported in part by said carousesl out of said chamber; inserting a new carousel with fresh drums into said chamber; reseating said removable top wall portion onto the flanged lip **22*a*** of said chamber, and replacing the upper microwave assembly.

Within the chamber 22, a plurality of elongated, cylindrical drum members 12 are supported by a removable carousel 36. The members 12 are specifically arranged so as to form a substantially closed interior loop with the longitudinal axes of those elongated members being disposed substantially parallel to one another and the outer circumferential surfaces of adjacent members 12 being closely spaced apart to define an inner plasma deposition chamber 32. In order to dispose the cylindrically-shaped members 12 in this closed loop configuration, the chamber 22 includes a carousel support wall 34, secured to a side wall of the chamber, said carousel support wall adapted to securely support a plurality of stationary shafts 38. Each of the cylindrically-shaped members 12 is mounted for rotation on a respective one of the shafts 38 by a pair of disc-shaped spacers 40 and 42. The spacers 40 and 42 have an outer dimension corresponding to the inner dimension of the cylindrically-shaped members 12 to thereby make frictional engagement with the inner circumferential surfaces of the cylindrically-shaped members 12 for accurately positioning said members 12 in parallel spaced relationship with respect to one another. The spacers 40 include a sprocket 44 arranged to engage a drive chain 46. The drive chain 46 makes a continuous loop around the sprockets 44 and a drive sprocket 48 of a motor 50. As a result, and as will be further explained hereinafter, during the deposition process, the motor 50 is energized to cause each of the cylindrically-shaped members 12 to be continuously rotated about its own longitudinal axis. This continuous rotation facilitates the uniform deposition of the semiconductor alloy material being deposited over the entire circumferential surface of each of the cylindrically-shaped members 12.

As previously mentioned, the cylindrically-shaped members 12 are operatively disposed so that the circumferential surfaces thereof are closely spaced apart to form the inner plasma deposition chamber 32. As can be noted from a perusal of FIG. 3, the reaction gases from which the deposition plasma is formed are introduced into the inner chamber 32 through at least one of a plurality of narrow passages 52 formed between at least one pair of adjacent cylindrically-shaped members 12. Preferably, the reaction gases are introduced into said inner chamber 32 through alternate ones of the narrow passages 52.

The perusal of FIG. 3 also reveals that each pair of adjacent cylindrically-shaped members 12 is provided with a gas inlet shroud 54. Each shroud 54 is connected to one of the reaction gas inlets 26, 28, and 30 by a conduit 56. Each shroud 54 defines a reaction gas reservoir 58 adjacent the narrow passage 52 between adjacent members 12 through which the reaction gas is introduced. The shrouds 54 further include lateral extensions 60 which extend from opposite sides of the reservoirs 58 and along the circumference of the cylindrically-shaped members 12 to form narrow channels 62 between the shroud extensions 60 and the outer circumferential surfaces of the cylindrically-shaped members 12.

The shrouds 54 are configured as described above so that the gas reservoirs 58 provide for relatively high reaction gas conduction while the narrow channels 62 provide a high resistance or low conduction of the reaction gases. Preferably, the vertical conductance of the reaction gas reservoirs 58 is much greater than the conductance of the narrow passages 52 between the drums. Further, the conductance of the narrow passages 52 is much greater than the conductance of the narrow channels 62. This assures not only that a large percentage of the reaction gas will flow into the inner chamber 32, but also that the gas flow along the entire lateral extent of the cylindrically-shaped members 12 will be uniform. Finally, the shrouds 54 further include side portions 64 which the overlap the distal end portions of the cylindrically-shaped members 12 and spacers 42 and 44. The side portions 64 are closely spaced from the end portions of the cylindrically-shaped members 12 and spacers 42 and 44 so as to continue the narrow channels 62 across the ends of the drums. Due to this configuration, the side portions 64 impede reaction gas flow around the ends of the members.

In order to introduce microwave energy into the inner chamber for forming the deposition plasma, identified by reference character 68 in FIG. 2, the apparatus 20 further includes a first microwave energy source 70 and a second, spacedly disposed microwave energy source 72. Each of the microwave energy sources 70 and 72 is illustrated as including an antenna probe 74 and 76, respectively. The probes operate to transmit microwave energy into the vicinity of the dielectric window. The microwave energy sources 70 and 72 can be, for example, microwave frequency magnetrons having an output frequency of, for example 2.45 GHz. Each of the energy sources 70 and 72 are placed in operative communication with a discrete, spacedly disposed waveguide structure 78 and 80, respectively. The antenna probes 74 and 76 are spaced from back walls 79 and 81 of the waveguide structures 78 and 80 by a distance of about one-quarter of the microwave wavelength. This spacing is provided to optimize the coupling of the microwave energy from the antenna probes into the waveguide structures. The waveguide structures 78 and 80 are operatively connected onto another introductory waveguide 82 and 84 respectively, which introductory waveguides project into the inner chamber of the vacuum chamber 22 and terminate in close proximity to the opposed distal edge portions of the elongated, cylindrically-shaped drum member 12. The introductory waveguides 82 and 84 are preferably fabricated from a durable, corrosion resistant metallic material which has low loss microwave transmission properties along the interior length thereof. The preferred material from which the introductory waveguides 82 and 84 are fabricated is stainless steel. It is to be noted that a pair of microwave introductory probes are utilized because the length of the cylindrically-shaped members are longer than the length of a microwave and accordingly it becomes necessary to introduce energy from opposed distal ends of the members in order to obtain a uniform plasma density throughout the length of the inner chamber.

Figure 4:
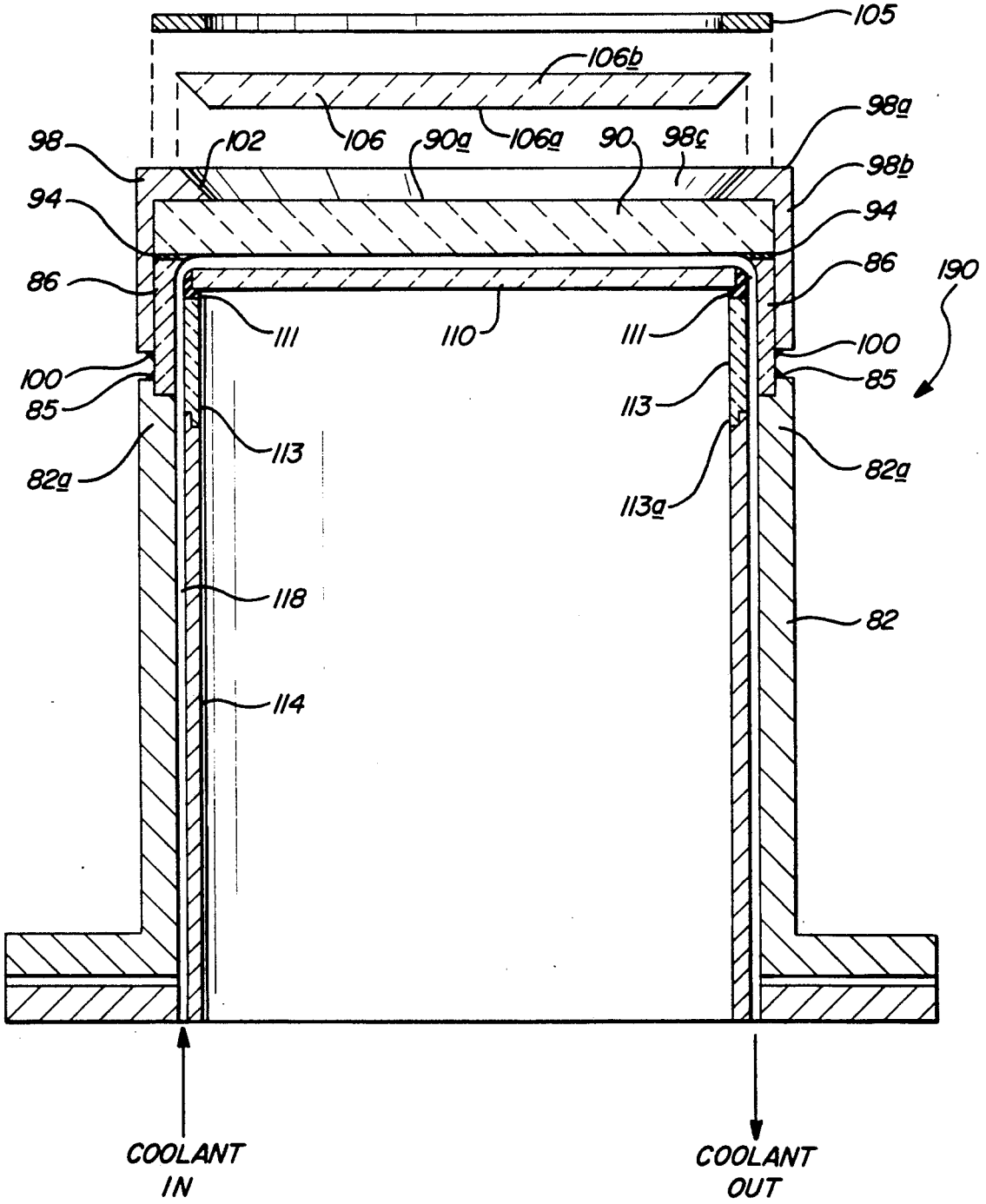
FIG. 4 is a detailed cut-away, cross-sectional side view of the improved high power multi-window assembly of the present invention illustrating the cooling channel thereof and the window arrangement employed there.

Turning now to FIG. 4, there is illustrated, in detail, the high power microwave transmissive window assembly 190 of the instant invention, as that assembly is operatively deployed in apparatus 20. It is to be noted that while FIG. 4 illustrates only one window assembly 190, apparatus 20 employs two, spacedly disposed window assemblies, each of which is substantially identical. Therefore, only a single window assembly need be illustrated, it being understood that the description which follows hereinafter is equally applicable to and fully descriptive of the second window assembly. Attached to the terminal end (the end closet to the vacuum chamber 22) of waveguide structure 80 is said waveguide tube 82, preferably fabricated from stainless steel. The waveguide tube 82 terminates interiorly of the vacuum chamber 22 and in close proximity to the inner chamber 32. In a preferred embodiment, a sealing tube 86 is permanently attached by means of a metallurgical process, i.e., a weld 85, to the terminal end 82*a* of tube 82 so as to affect a permanent vacuum connection therebetween. The sealing tube 86 is preferably fabricated from a material having a relatively low coefficient of thermal expansion, i.e., less than $7\times10^{-6}$ cm/cm/°C. and is typically between 0.5 and 36 inches in length. It is also preferred that the material used for said sealing tube 86 has a coefficient of thermal expansion which is substantially matched to that of the microwave transmissive dielectric window 90, described in detail hereinbelow. The criteria of matching thermal coefficients of expansions, while important, is not critical if the cooling of the window 90 is efficient. However, if either the cooling is not adequate to maintain the temperature of said window at a relatively low level or large quantities of microwave power are introduced into the chamber through the window for prolonged periods of time, it is important the rates of expansion of the dielectric window and the tube be matched. The preferred material for fabrication of said sealing tube 86 is KOVAR, (a registered trademark of Carpenter Technology Corp. of Reading, Pa.). KOVAR is a metallic alloy comprising approximately 29% nickel, 17% cobalt, 0.2% manganese and 63.8% iron, which material has a coefficient of thermal expansion of approximately $5\times10^{-6}$ cm/cm/°C. A suitable alternative to KOVAR is INVAR (a registered trademark of Carpenter Technology Corp. of Reading, Pa.), a metallic alloy comprising 0.02% carbon, 0.35% manganese, 0.2% silicon, 36% nickel and 63.43% iron. It is to be understood however that other materials possessing the desired thermal characteristics may also be employed.

The dielectric window 90 is the first of at least two cooperatively disposed, planar, dielectric, high power microwave transmissive windows, and is affixed to either said waveguide tube 82*a* or preferably to said sealing tube 86 by a deformable metallic alloy material 94 adapted to effect an air-tight closure between the dielectric window 90 and the sealing tube 86. In a preferred embodiment, the deformable metallic alloy seal 94 is formed of a material which is capable of withstanding temperatures of at least 1,000 degrees Centigrade, and preferably at least 1,200 degrees Centigrade, without softening. Any high temperature silver based braze alloy may be employed. The dielectric window 90 is urged against the seal 94 by a cup-shaped closure portion 98. the closure portion 98 includes a generally circular base 98*a* from which a circumferential side wall 98*b* perpendiculary depends. The circular base 98*a* includes a central aperture 98*c* formed therethrough for providing a passageway through which microwave energy can be transmitted to the inner chamber 32 after passing through the dielectric window 90. In a preferred embodiment, the apertured, cup-shaped closure portion 98 may be fabricated from stainless steel, and metallurgically attached, by weld 100, to the waveguide tube 82. The closure portion 98 is further adapted to protect the metallic alloy seal 94 while holding the dielectric window 90 seated at the distal end 82*a* of the waveguide tube, thus avoiding catastrophic failure of the apparatus 20 in the event that seal 94 becomes overheated or otherwise loses mechanical integrity.

First and foremost, the dielectric window 90 must be characterized by a high coefficient of thermal conductivity so that heat generated in the window is quickly transferred to a cooling medium which is circulated therepast. Additionally, the first dielectric microwave transmissive window 90 must be fabricated from a material having a relatively high resistance to thermal shock and a coefficient of thermal expansion substantially matched to the coefficient of thermal expansion of either the stainless steel tube 82*a* or the sealing tube 86. Note that since the silver based braze allow is thin and flowable, it forms an expansion joint between said steel tube 82*a* or said sealing tube 86 and said window 90.

The first dielectric, microwave transmissive window 90 (and a third dielectric microwave transmissive window 106) must be fabricated from materials having a high resistance to thermal shock, high heat resistance and a coefficient of thermal expansion substantially matched to the various means for supporting said windows. The window 90 must also isolate the sub-atmospheric vacuum plasma reaction chamber from the waveguide assembly (maintained at atmospheric pressure), thus preventing the formation of a plasma in the area of the antenna probes 74 and 76. Further, the window 90 must be relatively transparent to microwave energy. i.e., microwave energy having a frequency of about 2.45 GHz. To this end, the first window 90 is fabricated from a substantially cermic material, preferred ceramic materials including, without limitation, beryllium oxide (BeO), either stoichiometric or nonstoichiometric, or alumina ($Al_2O_3$), having a thickness which provides a relatively low standing wave ratio. Preferred thicknesses fall within the range of ⅛" to 2", with especially preferred thicknesses in the range of ¼" to ½". Note that this thickness dimension must also take into consideration the fact that the window 90 withstand the pressure differential which exist between the interior of the vacuum chamber and the waveguide structure positioned exteriorly thereof.

The window assembly 190 further includes a second generally planar dielectric window 110, preferably fabricated from a material transparent to relatively high power microwave energy such as alumina, beryllium oxide or silicon dioxide ($S_iO_2$). The second dielectric window 110 may be affixed to a second, corrosion resistant stainless steel tube 114 by means of a gas-tight, liquid-tight epoxy seal. In the preferred embodiment, the second dielectric window 110 is operatively affixed to a KOVAR tube 113 (approximately ½" to 36" in length) by means of a high temperature resistant silver alloy material 111 of the type dicussed hereinabove. The distal end portion 113*a* of the KOVAR tube 113 is then affixed to the second durable corrosion resistance stainless steel tube 114. The second tube 114 is spacedly disposed and metallurgically affixed, i.e., as by a weld, inside the concentrically oriented stainless steel waveguide tube 82. The second tube 114 and waveguide tube 82 are operatively disposed so as to define a channel region 118 through which a coolant medium is adapted to circulate between and remove heat from the intimately contacting first dielectric window 90 and the third dielectric window 106, described in detail hereinafter. More specifically, channel region 118 is adapted to provide for the circulation of a coolant medium as by a coolant pump (not shown) to maintain the dielectric windows 90, 106 and 110 and the seals 94 and 111 at a uniform, relatively low temperature for preventing catastrophic failure of the seals and breakage or cracking of the windows. The high power window assembly 190 is fabricated so that the heat flow path from the front of the first dielectric window 90 to the coolant medium is relatively short, direct and through a material characteristized by high thermal conductivity.

The coolant medium employed in the window assembly 190 may be either a gaseous or liquid coolant, and may vary depending largely upon the width of the channel 118 and the degree of cooling required. For example, if the channel region 118 can be kept reliably narrow, as for example, a uniform width of 1 centimeter or less, a coolant which is semi-microwave absorptive, such as water, may be used. As a matter of fact, water provides a preferred medium and the instant inventors have been surprised and delighted to discover contrary to expectations that the water coooling channel also provided excellent coupling of the microwave energy into the interior region. If, however, on the other hand, as the channel reion 118 is increase in width, for example, greater than 1 centimeter, then a coolant which is substantially non-microwave absorptive is preferably employed. To this end, the inventors of the instant invention have found that silicone oil possesses the required microwave transmissive properties and is compatible with vacuum conditions. Alternatively, where the cooling requirements are minimal, suitable gaseous coolant material be be circulated through the coolant channel 118. Preferred gaseous coolants must be substantially microwave transmissive, and are selected from the group consisting of air, nitrogen, hydrogen, helium or argon.

When the apparatus 20 is adapted to work in the deposition mode, it preferred that the edges 102 of the apertured base 98*a* of the closure portion 98 are canted so as to seat the an easily removable, third dielectric, high power microwave transmissive window 106. The third window 106 is removably seated in said apertured base 98*c* by means of a metallic ring 105, which ring is adapted to fit over and be affixed to the upper surface of the closure portion 98. As can be appreciated by viewing FIG. 4, the third dielectric window 106 has a lower planar surface 106*a* which is adapted to be operatively disposed in intimate contact with the exposed upper surface 90*a* of the first dielectric window 90, thus requiring said contacting surfaces to be highly polished so as to assure substantially complete surface contact therebetween. The third planar window, which may be fabricated from suitable microwave transmissive dielectric material, such as BeO or $A1_2O_3$, is adapted to shield the firstt planar window 90 and prevent it from becoming encrusted with the deposition species. The third window 106, being exposed to the plasma region is exposed to the plasma species generated by the microwave deposition apparatus, typically has the plasma facing surface 106*b* thereof coated by those species. A prolonged exposure to the plasma causes a thick build-up of the deposition species, which build-up can degrade the microwave coupling between the waveguide tube 82 and the inner chamber 32. Such degradation of coupling or crystallization of deposited species is unacceptable and it thus becomes necessary to regularly clean the surface 106*b* of the planar window 106 exposed to the plasma species. It should therefore be appreciated that an easily removable, planar dielectric window 106 must be provided when the microwave apparatus is employed in a deposition mode. The alternative is to repeatedly remove the first planar window 90 from the silver alloy seal 94, which alternative is costly and hence unacceptable.

As used in the foregoing description and the claims which follow hereinafter, the term "vacuum sealing means" refers to all elements by which the dielectric window is secured to the propagating means (such as the waveguide), in an air-tight, leak-proof manner, so as to effect the pressure differential which exists between the vacuum chamber and atmosphere. It is to be noted, as specified hereinabove, the silver alloy braze, while forming one or more elements of the vacuum sealing means, is thin and flowable. Therefore, the expansion and contraction of said braze relative to the expansion and contraction of the elements it joins is insignificant. Accordingly, the coefficient of thermal expansion of the braze may be ignored in considering the coefficient of thermal expansion of the sealing means and the dielectric window.

While the invention has been described in connection with preferred embodiments and procedures, it is to be understood that the detailed description was not intended to limit the invention to the described embodiments and procedures. On the contrary, the instant invention is intended to cover all alternatives, modifications and equivalences which may be included within the spirit and scope of the invention as defined by the claims appended hereto.

What is claimed is:

1. A window assembly for transmitting high power microwave energy from microwave propagating means, maintained at substantially atmospheric pressure, into the interior of a chamber maintained at subatmospheric pressure; said window assembly comprising;

dielectric means substantially transparent to microwave energy through which microwave energy is transmitted from said propagating means into the interior of said chamber, said dielectric means having a relatively high coefficient of thermal conductivity; said dielectric means further including a first generally planar window formed of a dielectric material and a second, spacedly disposed, concentrically oriented, generally planar window formed of a dielectric material;

vacuum sealing means cooperating with said dielectric means for maintaining the pressure differential between the chamber and the propagating means, said sealing means comprising a first and a second tube, said first tube affixed to said first planar window, and said second tube affixed to said second planar window; said sealing means includes a first and a second nickel:cobalt:iron tube; said first nickel: cobalt: iron tube affixed to said first planar window, and said second nickel: cobalt: iron tube affixed to said second planar window and said first and second tubes being concentrically oriented; said sealing means further includes a first stainless steel tube, metallurgically affixed to said first nickel: cobalt: iron tube, and a second stainless steel tube metallurgically affixed to said second nickel: cobalt: iron tube; and means for cooling said dielectric means and said sealing means as high power microwave energy is transmitted through said dielectric means, said cooling means adapted to maintain said dielectric means and said sealing means at a sufficiently low temperature to prevent overheating of said sealing means and cracking of said dielectric means; said cooling means comprising a channel formed by the space between said first and said second generally planar windows, a microwave absorptive cooling medium and means for circulating said microwave absorptive cooling medium through said channel.

2. An assembly as in claim 1, wherein the coefficient of thermal expansion of said sealing means is substantially matched to the coefficient of thermal expansion of said dielectric means.

3. An assembly as in claim 2, wherein at least one of said generally planar windows is formed of beryllium oxide.

4. An assembly as in claim 2, wherein both of said generally planar windows are formed of beryllium oxide.

5. An assembly as in claim 2, wherein the second of said spacedly disposed windows is formed of aluminum oxide.

6. An assembly as in claim 2, wherein the second of said spacedly disposed windows is formed of silicon dioxide.

7. An assembly as in claim 1, wherein the thickness of the first and second generally planar windows is from ⅛ to 2 inches thick.

8. An assembly as in claim 1, wherein the cooling medium is a liquid.

9. An assembly as in claim 8, wherein the cooling medium is water.

10. An assembly as in claim 9, wherein the channel thickness is greater than 1 mm.

11. An assembly as in claim 1, wherein a high temperature silver based alloy is used to affix said first tube to said first planar window and said second tube to said second window.

12. An assembly as in claim 1, wherein the length of said nickel:cobalt:iron tubes is from ½ to 36 inches.

13. An assembly as in claim 1, wherein a channel is formed between said pair of windows, said channel extending between the concentrically oriented first and second stainless steel tubes.

14. An assembly as in claim 13, wherein said cooling medium flows through the channel so as to thermally cool said sealing means and said dielectric means.

15. An assembly as in claim 1, wherein said microwave propagating means is a waveguide.

16. An assembly as in claim 1, wherein the dielectric means includes a third generally planar window formed of a dielectric material.

17. An assembly as in claim 16, wherein said third window is formed of beryllium oxide.

18. An assembly as in claim 16, wherein said third window is formed of aluminum oxide.

19. An assembly as in claim 16, wherein one of the planar surfaces of said third window is adapted to be operatively disposed in intimate contact with a surface of one of the first or second of said spacedly disposed windows.

20. An assembly as in claim 19, further including means for moving said third window into and out of intimate contact with said surface of one of said first or second windows.

21. An assembly as in claim 20, wherein said means for moving said third window facilitates the removal of said third window for the periodic replacement thereof.

22. An assembly as in claim 19, wherein the contacting surfaces of said third window and one of the first or second windows are polished to provide for substantially complete surface contact therebetween.

23. A window assembly for transmitting high power microwave energy from microwave propagating means, maintained at substantially atmospheric pressure, into the interior of a chamber maintained at subatmospheric pressure; said window assembly comprising:

dielectric means substantially transparent to microwave energy through which microwave energy is transmitted from said propagating means into the interior of said chamber, said dielectric means having a relatively high coefficient of thermal conductivity; said dielectric means further including a first generally planar window formed of a dielectric material and a second, spacedly disposed, concentrically oriented, generally planar window formed of a dielectric material;

vacuum sealing means cooperating with said dielectric means for maintaining the pressure differential between the chamber and the propagating means, said sealing means comprising a first and a second tube, said first tube affixed to said first planar window, and said second tube affixed to said second planar window;

means for cooling said dielectric means and said sealing means as high power microwave energy is transmitted through said dielectric means, said cooling means adapted to maintain said dielectric means and said sealing means at a sufficiently low temperature to prevent overheating of said sealing means and cracking of said dielectric means; said cooling means comprising a channel formed by the space between said first and said second generally planar windows, a microwave absorptive cooling medium and means for circulating said microwave absorptive cooling medium through said channel; and a fluorinated precursor etchant gas introduced into said chamber, whereby an etching operation is performed in said chamber.

24. A window assembly for transmitting high power microwave energy from microwave propagating means, maintained at substantially atmospheric pressure, into the interior of a chamber maintained at subatmospheric pressure; said window assembly comprising:

dielectric means substantially transparent to microwave energy through which microwave energy is transmitted from said propagating means into the interior of said chamber, said dielectric means having a relatively high coefficient of thermal conductivity; said dielectric means further including a first generally planar window formed of a dielectric material and a second, spacedly disposed, concentrically oriented, generally planar window formed of a dielectric material;

vacuum sealing means cooperating with said dielectric means for maintaining the pressure differential between the chamber and the propagating means, said sealing means comprising a first and a second tube, said first tube affixed to said first planar window, and said second tube affixed to said second planar window;

means for cooling said dielectric means and said sealing means as high power microwave energy is transmitted through said dielectric means, said cooling means adapted to maintain said dielectric means and said sealing means at a sufficiently low temperature to prevent overheating of said sealing means and cracking of said dielectric means; said cooling means comprising a channel formed by the space between said first and said second generally planar windows, a microwave absorptive cooling medium and means for circulating said microwave absorptive cooling medium through said channel; and precursor semiconductor gases including at least silicon or germanium introduced into said chamber, whereby a deposition operation is performed in said chamber.

25. A window assembly for transmitting high power microwave energy from microwave propagating means, maintained at substantially atmospheric pressure, into the interior of a chamber maintained at subatmospheric pressure; said window assembly comprising:

dielectric means substantially transparent to microwave energy through which microwave is transmitted from said propagating means into the interior of said chamber, said dielectric means having a relatively high coefficient of thermal conductivity; said dielectric means further including a first generally planar window formed of a dielectric material and a second, spacedly disposed, concentrically oriented, generally planar window formed of a dielectric material;

vacuum sealing means cooperating with said dielectric means for maintaining the pressure differential between the chamber and the propagating means, said sealing means comprising a first and a second tube, said first tube affixed to said first planar window, and said second tube affixed to said second planar window;

means for cooling said dielectric means and said sealing means as high power microwave energy is transmitted through said dielectric means, said cooling means adapted to maintain said dielectric means and said sealing means at a sufficiently low temperature to prevent overheating of said sealing means and cracking of said dielectric means; said cooling means comprising a channel formed by the space between said first and said second generally planar windows, a microwave absorptive cooling medium and means for circulating said microwave absorptive cooling medium through said channel; and precursor insulator gases introduced into said chamber, said precursor insulator gases including at least silicon selected so as to deposit insulating material in said chamber.

* * * * *